US006503078B1

(12) United States Patent
Hirano

(10) Patent No.: US 6,503,078 B1
(45) Date of Patent: Jan. 7, 2003

(54) NATURAL CONVECTION TYPE HEATING FURNACE

(76) Inventor: Bunzo Hirano, 539, Nishinoshima, Toyodo-Cho, Iwata-Gun, Shizuoka-Ken (JP)

( * ) Notice: Subject to any disclaimer, the term of this patent is extended or adjusted under 35 U.S.C. 154(b) by 0 days.

(21) Appl. No.: 08/605,736

(22) Filed: Feb. 22, 1996

(51) Int. Cl.[7] ..... F27B 9/00
(52) U.S. Cl. ..... 432/143; 432/194; 432/249
(58) Field of Search ..... 432/59, 133, 143, 432/150, 162, 194, 207, 212, 249

(56) References Cited

U.S. PATENT DOCUMENTS 4,964,799 A * 10/1990 Hirano ..... 432/59

* cited by examiner

*Primary Examiner*—Henry A. Bennett
*Assistant Examiner*—Gregory Wilson
(74) *Attorney, Agent, or Firm*—Adams & Wilks

(57) ABSTRACT

A heating furnace of convection type is provided for improving rising characteristics at an operation start-up time to stabilize conditions within the heating furnace in a shorter time and maintaining a uniform temperature in the furnace. The heating furnace comprises a conveyer unit for supporting an article to be heated and conveying the article through a heating chamber of a furnace body having an article inlet and outlet, a heating source provided in at least one of side and top portions of the furnace body such that the heating source is exposed to the interior of the heating chamber, an exhaust port formed in a lower portion of the heating chamber at a position displaced a predetermined distance from the heating source in the longitudinal direction of the furnace, the exhaust port being positioned below a lower end of the heated article, and an air inlet port associated with the heating source and provided below the exhaust port.

26 Claims, 6 Drawing Sheets

NATURAL CONVECTION TYPE HEATING FURNACE

BACKGROUND OF THE INVENTION

This invention relates to a heating furnace in which articles are heated for drying, painting with baking, etc., and more particularly to a natural convection type heating furnace which can improve rising characteristics at an operation start-up time to stabilize the condition within the heating furnace in a shorter time.

In heating furnaces of this type, appropriate heating sources are selected in view of heating efficiency, stability, uniformity and safeness etc. and so on. A heating furnace, in which liquid or gas fuel is burnt using a burner unit and combustion gas is directly introduced to the heating furnace for heating the articles, is economically advantageous because of high heat calories and because the equipment is simple and easy to use.

However, because a large amount of combustion gas must be supplied at all times, it is required to exhaust the same quantity of gas. The degree of heat efficiency of the heating furnace is determined by how heat calories taken away with the exhaust is reduced. As one preferable heating furnace, there is known a natural convection type heating furnace wherein hot air, i.e., combustion gas, is successively introduced to a mountain-shaped furnace body like a vessel laid upside down, and the gas having a temperature reduced after heating the articles in the furnace body is forced to flow out from below the furnace body. Such a heating furnace is disclosed in Japanese Patent Publication No. 58-12513, No. 59-42225 and No. 63-16673. All these heating furnaces have been invented by the inventors of this application.

The disclosed natural convection type heating furnaces have high heat efficiency and are very economical as a result of utilizing the natural convection process that hot air at a high temperature resides in an upper portion of the furnace body and the gas having a temperature reduced after heating articles in the furnace body is forced to descend due to the difference in density and then discharge out from below the furnace body.

In the prior art natural convection type heating furnaces, however, since the burner unit is installed under the furnace body, the degree of freedom in design is relatively small and a belt conveyor is hard to install over the lower floor surface. It is also difficult to effectively utilize the radiant heat generated with the combustion in the burner unit.

Meanwhile, there is a hot air circulating furnace wherein combustion gas burnt in a burner unit is forcibly introduced to a heating furnace by a circulation pump through an inlet duct for constant circulation of the gas. However, this hot air circulating furnace provides problems in that it requires a long rising time until the interior of the heating furnace reaches a uniform heating temperature condition, and also lacks rising stability in the start-up operation.

SUMMARY OF THE INVENTION

An object of the present invention is to substantially eliminate defects or drawbacks encountered in the prior art and to provide a heating furnace of natural convection type which can improve rising characteristics at the operation start-up time to stabilize the condition within the heating furnace in a shorter time and can maintain a uniform temperature in the furnace.

Another object of this invention is to provide a natural convection type heating furnace which can increase heating efficiency by effectively utilizing not only directly transferred heat but also radiant heat from a heating source and can maintain a stable and uniform heating space without causing significant fluctuations in heating surfaces within a furnace body.

Still another object of this invention is to provide a natural convection type heating furnace wherein a heating source is concentratedly arranged in a side or top portion of the furnace body to facilitate the maintenance thereof.

These and other objects can be achieved according to the present invention by providing a heating furnace of natural convection type comprising:

a furnace body having an inner heating chamber and provided with an inlet port through which an article to be heated is conveyed into the furnace body and an outlet port through which the article is discharged from the furnace body;

a conveyer means for supporting the article to be heated and conveying the article through the heating chamber of the furnace body from the inlet port to the outlet port;

a heating means disposed to the furnace body on at least one of side portion and top side portion of the furnace body at which the heating means is exposed to an interior of the heating chamber;

an exhaust means formed to a bottom portion of the furnace body with a predetermined distance from the heating means, said exhaust means having an upper end positioned below the article to be heated in the heating chamber of the furnace body; and an air inlet port provided below the exhaust means in association with the heating means.

In preferred embodiments, the exhaust means comprises a plurality of exhaust ports disposed apart from each other in a longitudinal direction of the furnace body between the inlet port and the outlet port and said heating means comprises a plurality of heating sources disposed apart from each other between the adjacent exhaust ports.

The heating means comprises infrared lamps, Nichrome heaters or gaseous infrared radiators.

An an air filter is disposed at a location of the air inlet port. Hoods are disposed in vicinities of the inlet port and the outlet port of the furnace body and discharge means are connected to the hoods.

The furnace body has a substantially straight structure or mount-shape structure in a longitudinal direction thereof.

Shield plates are formed to the inlet port and the outlet port so that the shield plates extend downward from longitudinal end portions of the top side portion of the furnace body to close upper predetermined portions of the inlet and outlet ports.

An air curtain means is disposed in the heating chamber in vicinities of the inlet port and the outlet port.

According to the structures of the present invention described above, in the heating furnace of this invention, as set forth above, the heating source is provided in at least one of side and top portions of the furnace body such that the heating source is exposed to the interior of the heating chamber. Therefore, articles can be heated by utilizing not only directly transferred heat but also radiant heat from the heating source. It is thus possible to increase heating efficiency, improve rising characteristics at the start-up time, and stabilize the condition in the heating chamber in a shorter time.

Furthermore, even with the interior of the furnace body directly heated by the heating source, the heating source provides the moderate heating action by effectively utilizing a combination of directly transferred heat and radiant heat. As a result, the heating chamber kept at a stable and uniform temperature can be established without causing significant fluctuations in heating surfaces within the furnace body.

Still furthermore, the heating source is concentratedly arranged between the exhaust ports provided in spaced relation in the longitudinal direction of the furnace. Therefore, it is possible to conduct maintenance for the heating source in one lot and improve the operability of maintenance and inspection. Additionally, a belt conveyor may be installed on the lower floor surface of the furnace body, which results in the increased degree of freedom in design.

Still furthermore, the location or arrangement of the shielding plates and the air curtain means can achieve various merits as described hereinafter.

The further nature and features of the present invention will be made more clear from the following descriptions made with reference to the accompanying drawings.

DETAILED DESCRIPTION OF THE PREFERRED EMBODIMENTS

The preferred embodiments of a heating furnace according to this invention will be described hereinafter with reference to the accompanying drawings.

Figure 1:
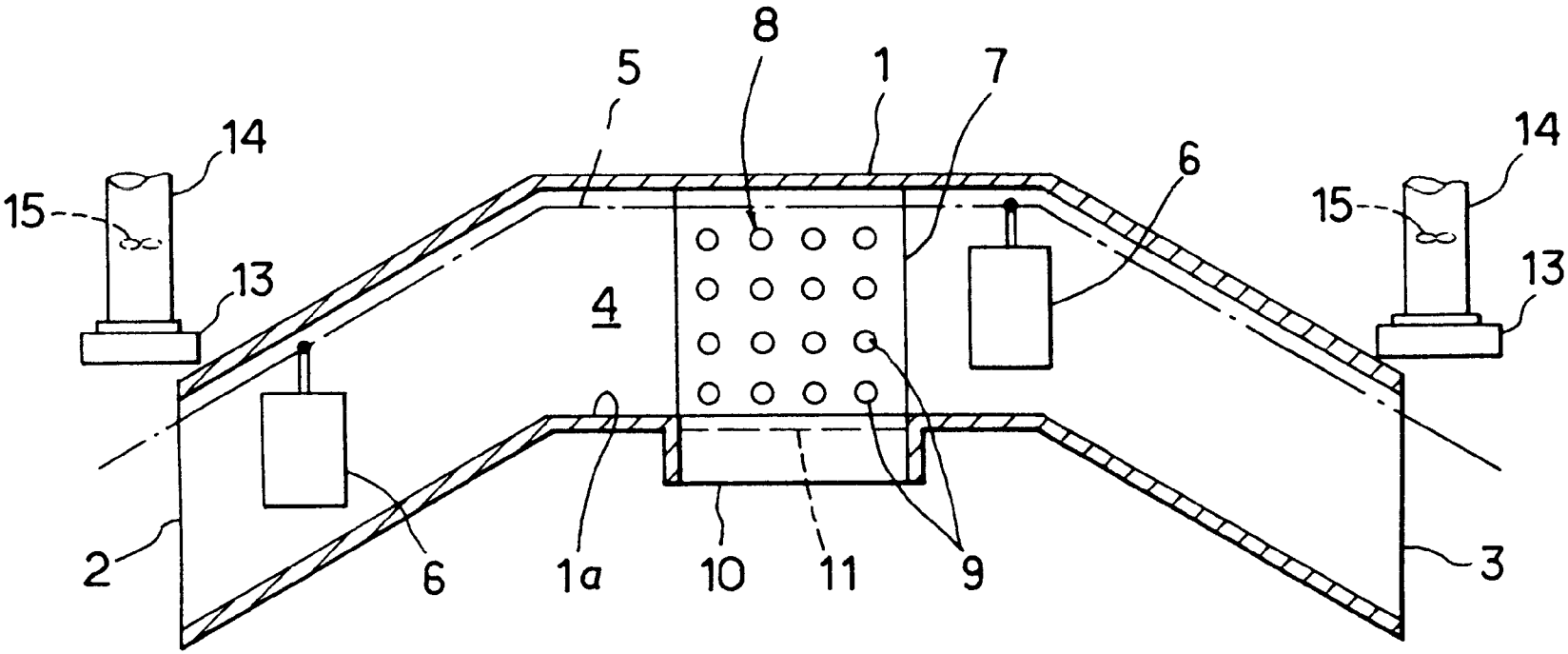
FIG. 1 is a longitudinal sectional view showing the basic structure of a heating furnace according to this invention.

FIG. 1 is a sectional view showing the basic structure of a natural convection type heating furnace according to this invention. The heating furnace includes a mountain-shaped furnace body 1 with both ends inclined downward and outwardly. The furnace body 1 has an article inlet 2 and an outlet 3 opened respectively at the longitudinal ends of the furnace body 1 and a heating chamber 4 formed therein. A conveyor line 5 is laid in the furnace body 1 along its top wall from the article inlet 2 to the article outlet 3. An article 6 to be heated for drying or painting with baking is conveyed by the conveyor line 5 in a suspended condition from the inlet port 2 to the outlet port 3.

Upper edges of the article inlet 2 and outlet 3 are set to position substantially at the same height as the surface level of a lower floor 1*a* of the furnace body 1, preferably slightly above the lower floor surface level. It is herein noted that the furnace body 1 is not necessarily required to have the lower floor 1*a* and the bottom of the furnace body may be open rather than providing the lower floor.

Both side walls of the furnace body 1 extending from the article inlet 2 to the article outlet 3 are each locally recessed so as to bulge outwardly to form a pit 7 in which heating means 8 is concentratedly disposed. The heating means 8 comprises infrared lamps 9, Nichrome heaters or gaseous infrared radiators. For example, the heating means 8 is made up by arraying the infrared lamps 9 in multiple vertical and horizontal lines with predetermined spacings therebetween such that the lamps are exposed to the interior of the heating chamber 4.

An air inlet port 10 is formed below the furnace body 1 in a position corresponding to the heating means 8 and, if necessary, an air filter 11 is provided in the air inlet port 10. A lower edge of the air inlet port 10 is positioned to have its level lower than at least the upper edges of the article inlet 2 to the article outlet 3 for the purpose of preventing hot air heated by the heating means 8 from flowing reversely and escaping out of the air inlet port 10.

On the other hand, hoods 13, 13 are disposed near and above the article inlet 2 and outlet 3 of the furnace body 1, respectively, and are connected to exhaust tubes 14. If necessary, an exhaust fan 15 is provided in the exhaust tube 14. In this case, the article inlet 2 and outlet 3 serve also as exhaust ports disposed remotely from the heating means 8 in the longitudinal direction of the furnace.

The heating operation of the heating furnace will be described below.

When the conveyor line 5 is driven into operation, the articles 6 to be heated are successively conveyed into the furnace body 1 from the article inlet 2 and then moved toward the article outlet 3 through the heating chamber 4.

The heating furnace is heated upon energization of the heating means 8. The interior of the heating furnace is heated by not only directly transferred heat but also indirect radiant heat from the heating means 8 up to a desired temperature, e.g., 80° C. to 230° C. Hot air heated by the heating means 8 ascends under the action of natural convection and, after impinging against the top wall of the furnace body 1, it spreads laterally in opposed directions so that the heating temperature in the heating chamber 4 becomes uniform substantially in the horizontal direction.

On the other hand, the air having a temperature reduced after heating the articles in the furnace body 1 is forced to descend under the action of the natural convection due to the difference in density and pushed by the ascending hot air. Then, the cooled air is discharged from the exhaust tubes 14 through the article inlet 2 and outlet 3.

Further, with the ascent of the air heated by the heating means 8, fresh air is introduced to the furnace chamber through the air inlet port 10 in an amount corresponding to the flow rate of the air discharged through the article inlet 2 and outlet 3. The introduced air is heated by the heating means 8 and the heated hot air is subjected to the action of natural convection as explained above. The foregoing process is repeated and the heating chamber 4 of the furnace body 1 is heated to an almost constant temperature.

Accordingly, an effective heating area (i.e., an area above the line connecting the upper edges of the article inlet 2 and outlet 3) in the furnace body 1 through which the heated articles 6 pass is filled with hot air at a high temperature. When this hot air at a high temperature is cooled by the articles 6 under heating, the air having a reduced temperature descends and is then discharged through the article inlet 2 and outlet 3. As a result, the interior of the furnace is always replaced by new hot air and a substantially uniform heat distribution is maintained in the effective heating space over the entirety thereof.

Furthermore, since the heating furnace includes heating sources provided in both the sides (or at the top) of the furnace body 1 such that the heating sources are exposed to the interior of the heating chamber 4, the heating chamber 4 can be heated by utilizing not only directly transferred heat but also radiant heat from the heating sources without leaking the heat to the exterior, thereby resulting in improved heating efficiency. It is thus possible to improve the rising characteristics at the operation start-up time of the heating furnace, shorten the rising time to half the time required in the prior art hot air circulating furnace, and maintain the heating chamber 4 at a stable and uniform temperature in a shorter time.

Figure 2:
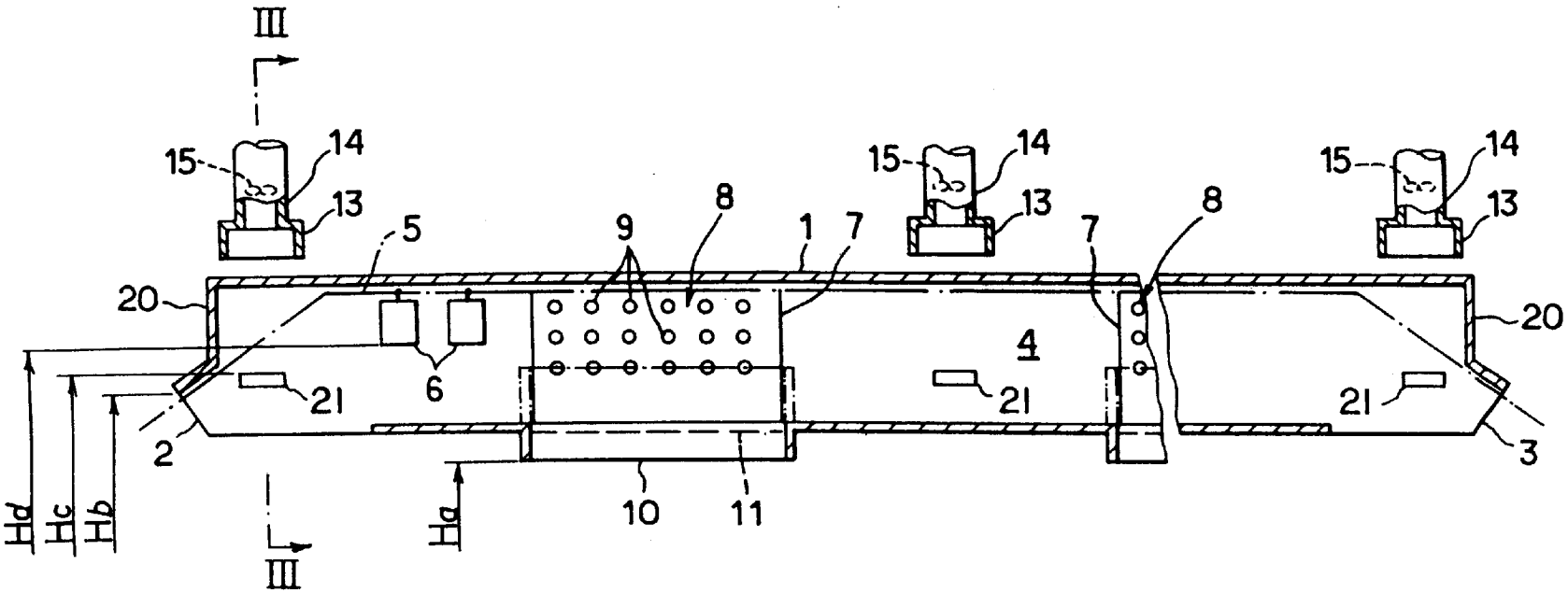
FIG. 2 is a cross sectional view showing one practical embodiment of the heating furnace according to this invention.

FIG. 2 shows one practical embodiment of the heating furnace according to this invention.

The heating furnace of this embodiment includes a tunnel-shaped furnace body 1 which lies nearly horizontally and extends longitudinally linear or in any desired curved form. At each of an article inlet 2 and outlet 3 of the furnace body 1, a shield plate 20 is formed by deeply bending a top wall of the furnace body downward. The shield plate 20 closes an upper half of each of the article inlet 2 and outlet 3, thereby essentially constituting a mountain-shaped furnace.

A conveyor line 5 is laid in the furnace body 1 along the top wall from the article inlet 2 to the article outlet 3. An article 6 to be heated is guided by the conveyor line 5 from the article inlet 2 to the article outlet 3. The conveyor line 5 rises in a portion near the article inlet and falls in a portion near the article outlet for guiding the heated article 6 so as to pass through an upper half of the furnace body 1. An air layer is formed in a lower portion of the furnace body 1.

Both side walls of the furnace body 1 are each locally recessed so as to bulge outwardly to form one or more pits 7 in which heating means 8 are disposed to be exposed to the interior of a heating chamber 4. The heating means 8 each comprise infrared lamps 9, Nichrome heaters or the like and are concentratedly disposed between discharge or exhaust ports 21, 21 provided in spaced relation in the longitudinal direction of the furnace for convenience of wiring and maintenance work. Instead of being provided at both the sides of the furnace body 1, the heating means 8 may be provided at the top alone or at both the sides and at the top of the furnace body.

The exhaust ports 21 are formed in the side wall of the heating body 1 respectively near the article inlet 2 and outlet 3 and, if necessary, at any desired position midway in the longitudinal direction of the furnace. The heating chamber 4 defined in the furnace body 1 is made open to the atmosphere through the exhaust ports 21. An air collecting hood 13 is disposed above each of the exhaust ports 21 of the furnace body 1 and connected to a lower end of an exhaust tube 14. If necessary, a forced exhaust fan 15 is provided midway the exhaust tube 14.

Assuming that the height of an upper edge of an air inlet port 10 through which air is supplied to the furnace body 1 is Ha, the height of a lower edge of the shield plate 20 is Hb, the height of an upper edge of the exhaust port 21 is Hc, and the height of lower end of the heated article 6 passing through the furnace is Hd from the reference surface, the heating furnace of this embodiment is set to satisfy the relationship of:

$$Ha<Hb\leqq Hc\leqq Hd$$

Figure 3:
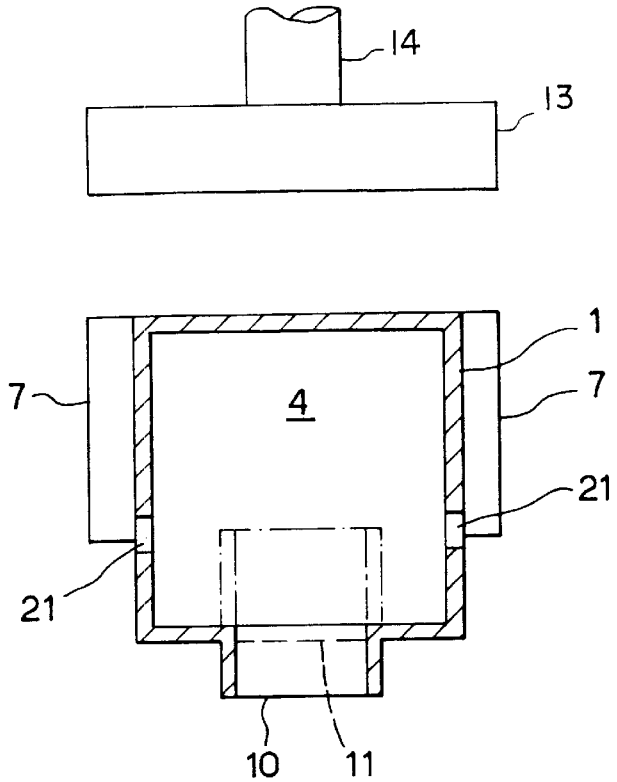
FIG. 3 is a sectional view taken along line III—III in FIG. 2.
Figure 4:
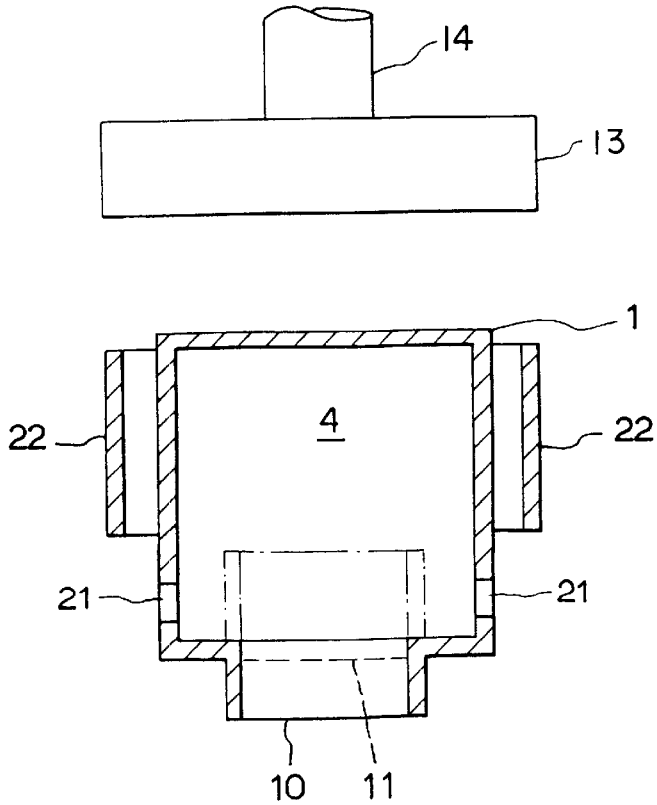
FIG. 4 is a sectional view taken along line III—III in FIG. 2, but showing another embodiment.

With the arrangement meeting the above condition, air introduced through the air inlet port 10 is heated by not only directly transferred heat but also indirect radiant heat from the heating means 8 up to a high temperature, thereby creating hot air. This hot air ascends under the action of natural convection and, after impinging against the top wall of the furnace body, it spreads laterally in opposed directions. The air cooled after heating the articles 6 is forced to descend under the action of natural convection and then overflow to the atmosphere through the exhaust parts 21 in such a sequence that an air mass having a lower temperature first flows out. Since the exhaust port 21 is not directly coupled to the exhaust tube 14, the exhaust port does not have a chimney effect (i.e., suction effect). Additionally, the side walls of the furnace body 1 may be formed as shown in FIG. 3 or air guiding ducts 22 may be provided on outer surfaces of the side walls as shown in FIG. 4.

Because of no direct connection between the exhaust ports 21 and the exhaust tubes 14, the hot air at a high temperature will not be forcibly sucked out through the exhaust ports 21. The high-temperature hot air heated by the heating means 8 resides in an upper portion of the heating chamber 4 in the furnace body 1 and efficiently heats the articles 6 passing through the heating chamber 4 under the action of natural convection. Since the hot air heated by the heating means 8 is all effectively utilized to heat the articles 6 in the furnace body 1, the heat efficiency can be remarkably improved. Further, by adjusting the amount of heat supplied from the heating means 8, the temperature in the heating chamber 4 of the furnace body 1 can be easily adjusted to a desired value, e.g., on the order of 80° C. to 230° C. Furthermore, a temperature distribution in the heating chamber 4 of the furnace body 1 can be kept uniform. The temperature in the heating chamber 4 may be set to any of various values depending on the required conditions of drying, painting with baking, etc., but the temperature in the heating chamber 4 exceeding 230° C. is not desired because the conveyor would tend to run out of oil soon.

With the air layer formed in the furnace body 1 below the exhaust ports 21, the hot air containing a solvent is allowed to escape into the air layer for diffusion and dilution of the solvent while the heated articles 6 are being conveyed th rough the furnace body 1. It is therefore possible to effectively prevent the solvent such as thinner from catching fire, thereby avoiding explosion of the heating furnace and improving safety.

Moreover, in this heating furnace utilizing the natural convecti on process, the heated articles are conveyed and guided through the furnace body 1 such that the lower ends of the articles are kept at a level above the lower edges of the shield plates 20, the air inlet port 10 associated with the heating means 8 is positioned below the lower edges of the shield plates 20, and the lower edges of the exhaust ports 21 disposed at least near the article inlet and outlet of the furnace body are positioned above the lower edges of the shield plates 20 and below the lower ends of the heated articles 6. Therefore, the articles 6 can be effectively heated for painting with baking, by way of example, under the action of natural convection. It is thus possible to establish the moderate and uniform heating condition and improve the quality of products.

Additionally, since the air inlet port 10 is disposed below both the lower edges of the shield plates 20 and the upper edges of the exhaust ports 21 during the operation of the heating furnace utilizing the natural convection process, the air is prevented from flowing reversely through the air inlet port 10 and the exhaust ports 21, and the articles 6 can be heated effectively and stably.

Figure 5:
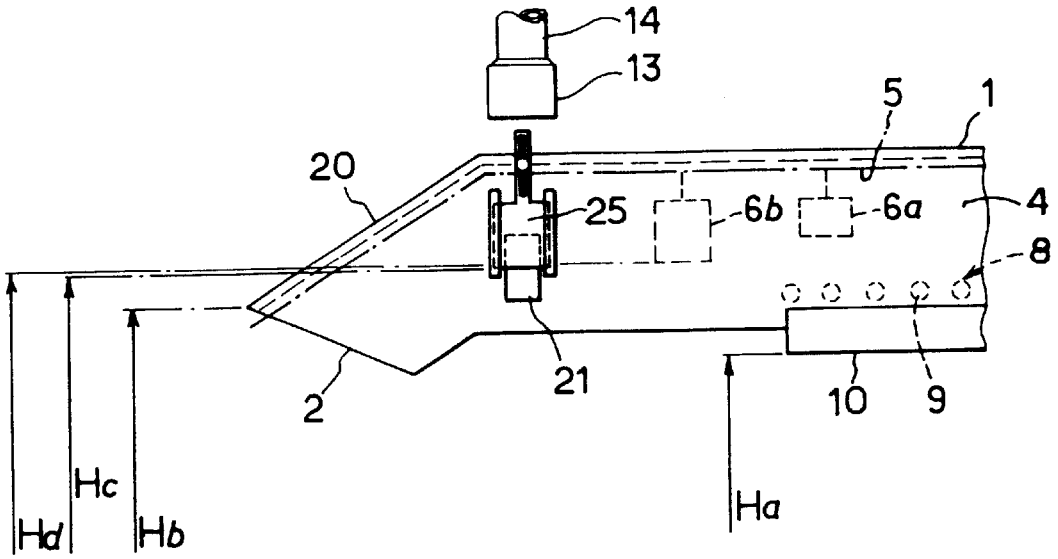
FIG. 5 is a sectional view showing a first modification of the heating furnace according to this invention.

FIG. 5 shows a first modification of the heating furnace of FIG. 2 according to this invention.

The heating furnace of this modification has the same structure as shown in FIG. 2 except that shield plate 20 is extended downward and obliquely so as to define an article inlet 2 and outlet (not shown) of the furnace body 1. The height Hb of a lower edge of the shield plate 20 and the height Ha of an upper edge of an air inlet port 10 associated with the heating means 8 are set to satisfy the relationship of $Ha<Hb$.

An adjusting plate 25 capable of moving vertically is attached to an exhaust port 21 so that the height Hc of an upper edge of the exhaust port 21 is changed upon adjustment of the adjusting plate 25. However, the relationship of $Hb \leqq Hc$ must be satisfied even when the upper edge of the exhaust port 21 is adjusted to the lowest position.

A conveyor line 5 is laid in the furnace body 1 along its top wall, and articles 6*a*, 6*b* to be heated are moved by the conveyor line 5 in a suspended condition. Because articles have their lower ends different in height between a time when the small article 6*a* is suspended and a time when the large article 6*b* is suspended, the adjusting plate 25 is vertically adjusted for each article to set the upper edge height of the exhaust port 21 corresponding to the lower end height of the article so that the relationship of $Hb \leqq Hc \leqq Hd$ is optimized. As a result, fuel or power consumption can be reduced to the necessary minimum amount depending on the sizes of the heated articles 6*a*, 6*b*.

In the heating furnace wherein the article inlet 2 and outlet 3 serve also as the exhaust ports 21, it is preferable to make the lower edge height of the shield plate 20 adjustable vertically.

Figure 6:
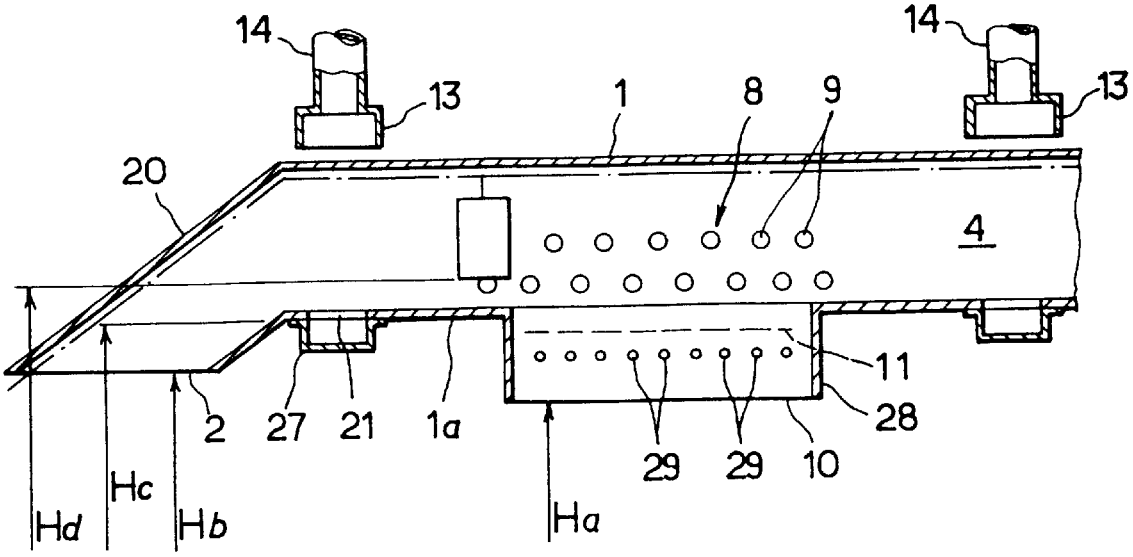
FIG. 6 is a sectional view showing a second modification of the heating furnace according to this invention.

FIG. 6 shows a second modification of the heating furnace of FIG. 2 according to this invention.

In the heating furnace of this modification, exhaust ports 21 are each formed in a lower floor 1*a* of the furnace body, and exhaust air flowing out of the exhaust port 21 is guided laterally through an exhaust guide 27 for release to the atmosphere.

It is desired that this modified heating furnace also meets the relationship of:

$$Ha<Hb \leqq Hc \leqq Hd$$

Burner units 29 may be installed in a duct 28 defining an air inlet port 10 to heat air flowing in through the port 10.

Figure 7:
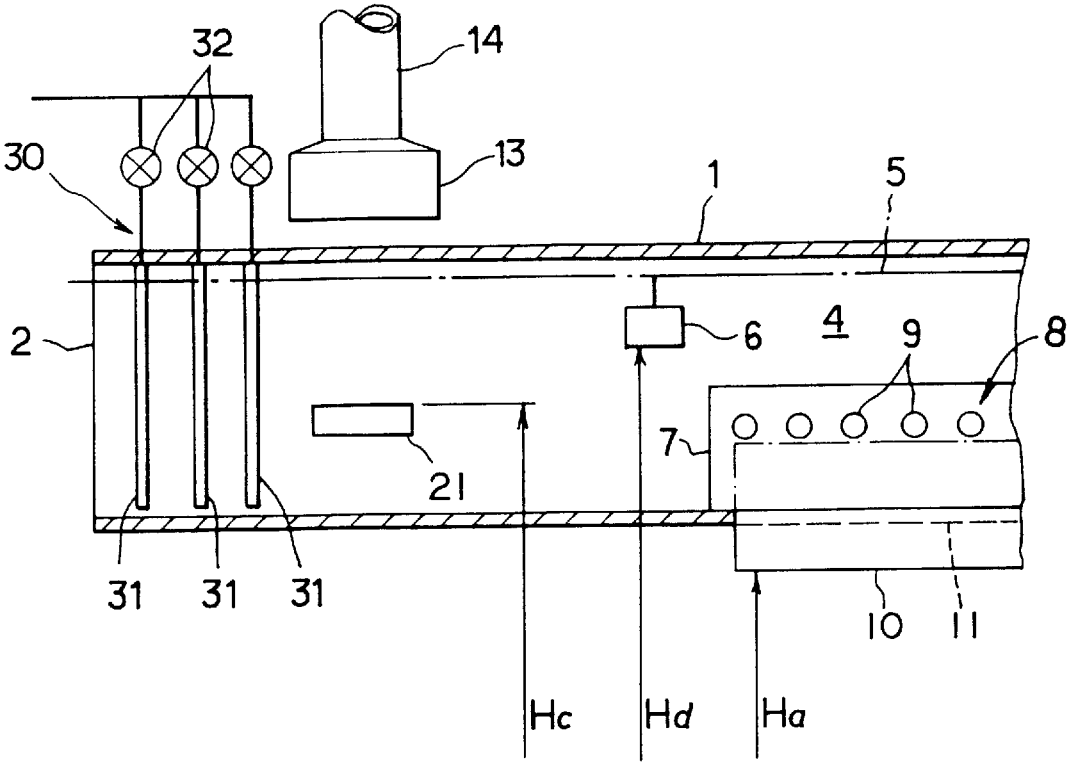
FIG. 7 is a sectional view showing a third modification of the heating furnace according to this invention.

FIG. 7 shows a third modification of the heating furnace of FIG. 2 according to this invention. In the heating furnace of this modification, an air curtain unit 30 is installed at each of an article inlet 2 and outlet (not shown) for isolating the atmosphere inside the heating chamber from the ambient air. With the provision of the air curtain unit 30, the heating furnace having a line ar shape rather than a mountain-like shape can also be constructed with essentially the same function as the mountain-shaped furnace.

The air curtain unit 30 comprises pairs of blowoff ducts 31 attached to one side wall of the furnace body 1 in a portion near each of the article inlet and outlet and suction ducts (not shown) attached to the other side wall, these pairs of ducts being extended vertically side by side in opposed relation for each pair. The blowoff ducts 31 are connected to an air supply source through regulating valves 32, and the suction ducts are connected to a suction device (not shown).

The remaining structure is essentially the same as that of the heating furnace shown in FIG. 2 and hence will not be described here.

Figure 8:
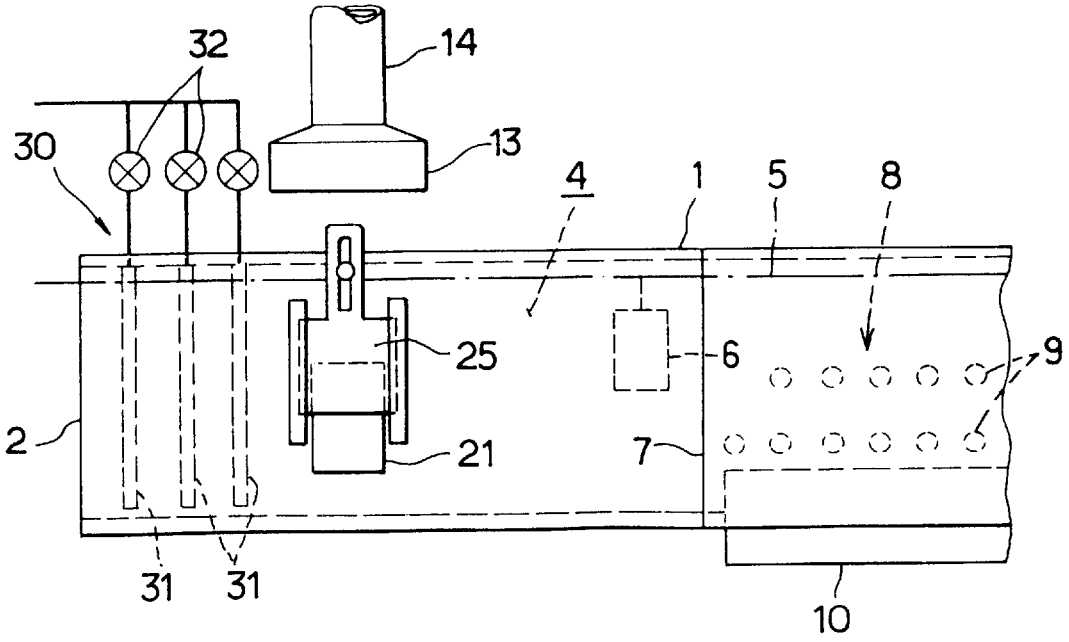
FIG. 8 is a sectional view showing a fourth modification of the heating furnace according to this invention.

FIG. 8 shows a fourth modification of the heating furnace of FIG. 2 according to this invention.

In the heating furnace of this modification, the exhaust structure for the heating furnace shown in FIG. 5 and the air curtain unit 30 shown in FIG. 7 are combined with each other.

In the heating furnace according to any one of the above-explained modifications, air sucked through the air inlet port 10 is heated by the heating means 8 provided in both the sides or at the top of the furnace body 1 up to a high temperature, and this hot air having a raised temperature ascends under the action of natural convection so as to always fill an upper portion of the furnace body 1 with the high-temperature hot air. Then, articles are heated in the upper portion of the furnace body 1 held at a high temperature. The exhaust ports 21 and the other parts are arranged on the rational basis so that the articles can be effectively heated with thermal energy in necessary minimum amount. Consequently, fuel or power consumption is reduced to a large extent.

To effectively utilize the thermal energy in heating furnaces of the type employing hot air, a hot air circulating furnace has been mainly practiced in the past. In comparison with such a hot air circulating furnace, the heating furnace according to this invention needs no longer a special burner, a blower, ducts, etc. This simplification of the structure makes it possible to reduce the cost necessary for equipment and installation. Furthermore, because of utilizing the natural convection process, the air in the furnace is effectively replaced by fresh air and impurity molecules are surely discharged out soon to prevent the articles under painting with baking from suffering contamination in their painted coatings. Additionally, since the flowing speed of the hot air is slow, the heating condition is moderate and uniform and the quality of products can be improved.

Figure 9:
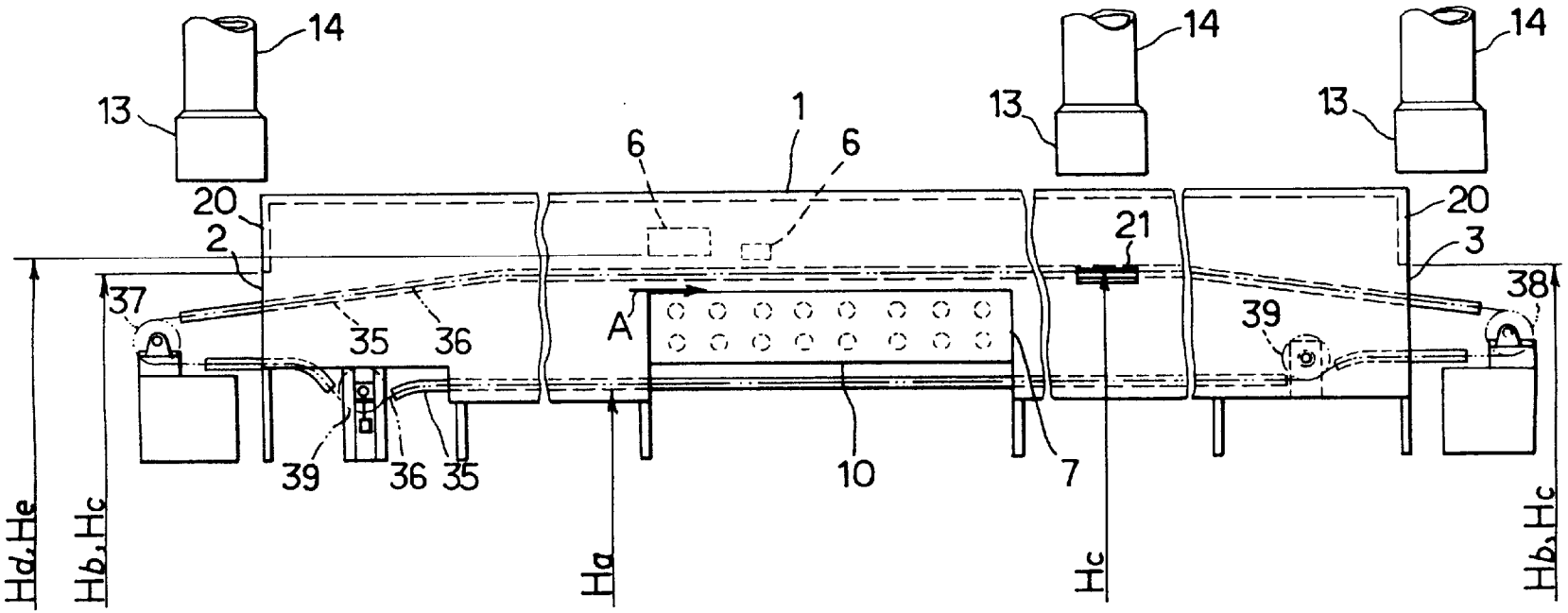
FIG. 9 is a longitudinal sectional view showing another practical embodiment of the heating furnace according to this invention.

FIG. 9 shows another practical embodiment of the heating furnace according to this invention.

The heating furnace of this embodiment includes a shield plate 20 covering an upper half of each of an article inlet 2 and outlet 3 of the furnace body 1, and an exhaust port 21 provided, if necessary, in a middle portion of the furnace body 1. The height Hb of a lower edge of the shield plate 20 and the height Hc of an upper edge of the exhaust port 21 are set to satisfy the relationship of $Hb=Hc$. Then, the article inlet 2 and outlet 3 are also utilized as exhaust ports. To this end, an exhaust tube 14 is disposed above each of the article inlet 2 and outlet 3, and an air collecting hood 13 is connected to a lower end of the exhaust tube 14 to be open above the corresponding inlet 2 or outlet 3.

Both side walls of the furnace body 1 are each locally recessed so as to bulge outwardly to form a pit 7 in which heating means 8 comprising infrared lamps 9, Nichrome heaters or the like are concentratedly disposed. Air introduced through an air inlet port 10 is heated up to a high temperature with directly transferred heat and indirect radiant heat from the heating means 8.

On the other hand, guide rails 35 are laid in the furnace body 1 along both side walls and an endless conveyor 36 is mounted on and guided by the guide rails 35.

The belt conveyor 36 is guided such that its upper surface rises in a portion passing the article inlet 2 and falls in a portion passing the article outlet 3. The height He of the upper surface of the belt conveyor 36 passing through the furnace body 1 is set to satisfy the relationship of He≦Hb=Hc so that the conveyor surface is positioned at the same level as or above the height Hb of the lower edge of the shield plate 20 and the height Hc of the upper edge of the exhaust port 21.

The belt conveyor 36 is slowly move d in the direction indicated by an arrow A, and articles 6 placed on the conveyor surface to be heated pass through the furnace body 1 in a predetermined time. Since lower ends of the heated articles 6 are always positioned at the height of the upper surface of the belt conveyor 36 regardless of sizes, the relationship of Ha<Hb≦Hc≦Hd is satisfied as mentioned above and the articles are effectively heated. Reference numeral 37 denotes a drive wheel for the belt conveyor 36, numeral 38 is a driven wheel and numeral 39 is a tension wheel.

The heating furnace of this embodiment can also operate with similar resultant advantages as in the heating furnace shown in FIG. 2.

According to the heating furnace of this invention, as described hereinabove, since the heating source is provided in at least one of side and top portions of the furnace body such that the heating source is exposed to the interior of the heating chamber, articles can be heated by utilizing not only directly transferred heat but also radiant heat from the heating source. It is therefore possible to increase heating efficiency, improve rising characteristics at the operation start-up time, and stabilize the condition in the heating chamber in a shorter time.

Also, even with the interior of the furnace body directly heated by the heating source, the heating source provides the moderate heating action by effectively utilizing a combination of directly transferred heat and radiant heat. As a result, a heating chamber kept at a stable and uniform temperature can be established without causing significant fluctuations in heating surfaces within the furnace body.

Further, since the heating source is arranged in a concentrated fashion between the exhaust ports provided in spaced relation in the longitudinal direction of the furnace, it is possible to conduct maintenance work for the heating source in one lot and improve the maintenance and inspection. Additionally, since a belt conveyor may be installed on the lower floor surface of the furnace body, the degree of freedom in design can be increased.

What is claimed is:

1. A heating furnace of natural convection type comprising:

a furnace body having an inner heating chamber and provided with an inlet port through which an article to be heated is conveyed into the furnace body and an outlet port through which the article is discharged from the furnace body;

conveying means for supporting the article to be heated and conveying the article through the heating chamber of the furnace body;

heating means disposed on at least one of a side portion and a top side portion of the furnace body and exposed to an interior of the heating chamber for heating air in the heating chamber to heat the article;

exhaust means formed on a bottom portion of the furnace body at a predetermined distance from the heating means for discharging the heated air from the heating chamber after the heated air has been cooled, the exhaust means having an upper end positioned below the article to be heated in the heating chamber of the furnace body; and an air inlet port provided below the exhaust means in association with the heating means.

2. A heating furnace according to claim 1; wherein the exhaust means comprises a plurality of exhaust ports disposed apart from each other in a longitudinal direction of the furnace body between the inlet port and the outlet port; and wherein the heating means comprises a plurality of heating sources disposed apart from each other, each of the heating sources being disposed between two adjacent exhaust ports.

3. A heating furnace according to claim 1; wherein the heating means comprises infrared lamps.

4. A heating furnace according to claim 1; wherein the heating means comprises Nichrome heaters.

5. A heating furnace according to claim 1; wherein the heating means comprises gaseous infrared radiators.

6. A heating furnace according to claim 1; further comprising an air filter disposed in the air inlet port.

7. A heating furnace according to claim 1; further comprising hoods disposed in the vicinity of the inlet port and the outlet port and connected to the discharge means for collecting the discharged air.

8. A heating furnace according to claim 1; wherein the furnace body comprises a substantially straight, longitudinally extending structure.

9. A heating furnace according to claim 8; further comprising a shield plate disposed at each of the inlet port and the outlet port, the shield plates extending downward from longitudinal end portions of the top side portion of the furnace body to close predetermined upper portions of the inlet and outlet ports.

10. A heating furnace according to claim 1; further comprising air curtain means disposed in the heating chamber in the vicinity of each of the inlet port and the outlet port for isolating the atmosphere inside the heating chamber from the ambient air.

11. A heating furnace of natural convection type according to claim 1; wherein the heating means is disposed on the side portion of the furnace body.

12. A heating furnace of natural convection type according to claim 1; wherein the heating means is disposed on the top side portion of the furnace body.

13. A natural convection type heating furnace for heating articles, comprising:

a furnace body having an upper portion, a lower portion, and a pair of opposed side wall portions, the furnace body defining a heating chamber having an inlet port for admitting articles to be heated into the heating chamber and an outlet port for discharging heated articles from the heating chamber;

a conveying device for conveying articles through the heating chamber from the inlet port to the outlet port;

at least one heating device disposed on a portion of the furnace body other than the lower portion thereof for heating air contained in the heating chamber to heat the articles being conveyed through the heating chamber; and at least one discharge port disposed on the furnace body for discharging the heated air from the heating chamber after the heated air has been cooled.

14. A natural convection type heating furnace according to claim 13; wherein the heating device is disposed on the upper portion of the furnace body.

15. A natural convection type heating furnace according to claim 13, wherein the heating device is disposed on the side wall portions of the furnace body.

16. A natural convection type heating furnace of natural convection type according to claim 13; wherein the heating device is disposed on the upper portion and the side wall portions of the furnace body.

17. A natural convection type heating furnace according to claim 13; wherein the discharge port is disposed on the lower portion of the furnace body.

18. A natural convection type heating furnace according to claim 13; further comprising an air inlet port disposed on the lower portion of the furnace body proximate the heating device for introducing air into the heating chamber.

19. A natural convection type heating furnace comprising:

a furnace body having an upper portion, a lower portion, and a pair of opposed side wall portions, and defining a heating chamber having an inlet port for admitting articles to be heated into the heating chamber and an outlet port for discharging the heated articles from the heating chamber;

a conveying device for conveying articles through the heating chamber from the inlet port to the outlet port;

a plurality of heating devices disposed on a portion of the furnace body other than the lower portion thereof for heating air contained in the heating chamber to heat the articles conveyed through the heating chamber;

a plurality of discharge ports disposed on the furnace body and spaced apart along a longitudinal direction thereof for discharging the heated air from the heating chamber after the heating air has been cooled; and a plurality of air inlet ports each disposed on the furnace body proximate one of the heating devices for introducing air into the heating chamber.

20. A natural convection type heating furnace according to claim 19; wherein the heating devices are spaced apart and extend along the longitudinal direction of the furnace body, each of the heating devices being disposed between two adjacent discharge ports.

21. A natural convection type heating furnace according to claim 19; wherein the heating devices are disposed on the upper portion of the furnace body.

22. A natural convection type heating furnace according to claim 19; wherein the heating devices are disposed on the sidewall portions of the furnace body.

23. A natural convection type heating furnace according to claim 19; wherein the heating devices are disposed on the upper portion and the sidewall portions of the furnace body.

24. A natural convection type heating furnace according to claim 19; wherein the discharge ports are disposed on the lower portion of the furnace body.

25. A natural convection type heating furnace according to claim 13; further comprising an air curtain unit disposed in the heating chamber in the vicinity of each of the inlet port and the outlet port for isolating the atmosphere inside the heating chamber from the ambient air.

26. A natural convection type heating furnace according to claim 19; further comprising an air curtain unit disposed in the heating chamber in the vicinity of each of the inlet port and the outlet port for isolating the atmosphere inside the heating chamber from the ambient air.

* * * * *